US007097123B2

(12) United States Patent
Lepage et al.

(10) Patent No.: US 7,097,123 B2
(45) Date of Patent: Aug. 29, 2006

(54) BALE PROCESSOR WITH GRAIN MIXING ATTACHMENT

(75) Inventors: Charles Lepage, Saskatoon (CA); Philip Reddekopp, Warman (CA); Kimball Lischynski, Saskatoon (CA); Murray Kosokowsky, Saskatoon (CA)

(73) Assignee: Highline Mfg. Inc., Vonda (CA)

( * ) Notice: Subject to any disclaimer, the term of this patent is extended or adjusted under 35 U.S.C. 154(b) by 94 days.

(21) Appl. No.: 10/995,530

(22) Filed: Nov. 24, 2004

(65) Prior Publication Data

US 2006/0108460 A1 May 25, 2006

(51) Int. Cl.
*B02C 19/12* (2006.01)

(52) U.S. Cl. ..... 241/101.6; 241/605

(58) Field of Classification Search ..... 241/101.763, 241/604, 605, 101.6, 186.4
See application file for complete search history.

(56) References Cited

U.S. PATENT DOCUMENTS 4,092,004 A * 5/1978 Leverenz et al. ..... 241/56
4,174,072 A * 11/1979 Kline ..... 241/35
5,340,040 A 8/1994 Bussiere et al.
6,199,781 B1 3/2001 Hruska
6,467,710 B1 10/2002 Patterson
6,578,784 B1 6/2003 Lischynski et al.
6,708,911 B1 3/2004 Patterson et al.

* cited by examiner

*Primary Examiner*—Mark Rosenbaum
(74) *Attorney, Agent, or Firm*—Adrian D. Battison; Michael R. Williams; Ryan W. Dupuis

(57) ABSTRACT

A bale processor on a wheeled vehicle has a hopper converging inwardly and downwardly to a lower disintegration area at which is located a flail roller rotatable about an axis extending generally along the hopper and including a drive roller or rollers in the hopper for driving rotation of the bale around an axis parallel to the flail roller axis. The processed material is discharged from the disintegration area at the flail roller through an opening in one side wall of the hopper to form a row along that side of the vehicle. A container for particulate material, such as grain, to be added to and mixed with the processed material is carried at the side wall opposite the discharge opening and has an auger tube extending from the container to the hopper at a height below the flail roller and mid way along the side wall so as to introduce the grain into the processed material to mix therewith in the disintegration area.

15 Claims, 4 Drawing Sheets

BALE PROCESSOR WITH GRAIN MIXING ATTACHMENT

This invention relates to a bale processor which includes a grain mixing attachment.

The term "grain" used herein is intended to include other particulate materials which are used as an addition or supplement to baled hay or silage material. While such particulate materials, which are commonly or typically used, may be formed from grain alone, they can include other supplements or may be wholly formed from other supplements.

BACKGROUND OF THE INVENTION

U.S. Pat. No. 5,340,040 (Bussiere et al.), U.S. Pat. No. 6,578,784 (Lischynski) issued Jun. 17, 2003 and U.S. Pat. No. 6,708,911 (Patterson) issued Mar. 23$^{rd}$ 2004 to Highline Manufacturing Inc. disclose details of a known type of bale processor in which there is provided a hopper with two end walls and two side walls converging inwardly and downwardly to a discharge area at the bottom of the side walls. One of the side walls has an opening at the discharge area to allow material to be discharged. Within the hopper is provided one or more driven rollers which act to rotate the bale around its axis arranged longitudinally of the hopper. At the bottom of the hopper is provided a flail roller which rotates around an axis longitudinally of the hopper and carries a priority of flails for engaging and removing the baled crop material to be discharged through the discharge opening. The disclosures of these patents is incorporated herein by reference so that further details not specifically disclosed herein may be obtained by reference to those documents.

Mixing of grain and/or other particulate additives to hay for feeding animals is well known and widely used. Various arrangements for mixing using drums and the like are well known. In recent years bales crop materials have been processed using a machine of the type of Highline above and as shown in U.S. Pat. No. 6,199,781 (Hruska) issued Mar. 13$^{th}$ 2001 and U.S. Pat. No. 6,644,575 (Farrell) issued Nov. 11$^{th}$ 2003 attachments have been provided for such machines by which the particulate additive is applied onto the row of hay along side the machine after the hay has been laid. Thus a container is attached to the front or rear of the machine and a conveyor carries the material to the rear of the vehicle to drop the material onto the row.

Another machine is disclosed in U.S. Pat. No. 6,467,710 (Patterson) issued Oct. 22$^{nd}$ 2002 which uses a conveyor carrying bales to a disintegration system which co-operates with another conveyor for the particulate material to drop the two materials onto a discharge conveyor. This arrangement is less satisfactory because it does not use the hopper type bale processor which has become well established in this industry.

SUMMARY OF THE INVENTION

It is one object of the invention to provide an improved bale processor which effectively and simply provides an attachment for mixing particulate additives into a bale processor.

According to one aspect of the invention there is provided a bale processor comprising:

a hopper for receiving material in a bale to be processed having four walls including two side walls and two end walls arranged to define an open top through which the bale is loaded;

the two side walls converging inwardly and downwardly to a lower disintegration area;

a flail roller mounted in the disintegration area and rotatable about an axis extending generally along the side walls and transverse to the end walls to generate processed material removed from the bale;

at least one drive member in the hopper for applying a rotation force to the bale tending to rotate the bale around an axis generally parallel to the flail roller axis;

one of the side walls having a discharge opening at the disintegration area for discharge of the processed material removed from the bale by the flail roller;

the hopper being mounted on a wheeled vehicle for movement forwardly in a direction of operation;

the discharge opening being arranged to form the material into a row along the side of the wheeled vehicle as the vehicle moves forwardly;

a container carried on the vehicle for receiving a particulate material;

a conveyor for transporting the particulate material from the container;

the conveyor being arranged to transport the particulate material into the hopper so as to be discharged from the conveyor into the hopper to mix with the material prior to discharge through the discharge opening.

The vehicle is preferably a trailer but can be provided by any suitable support or mounting which allows the hopper to be transported.

Preferably the conveyor extends through one of the four walls to discharge the particulate material into the hopper. It could however be routed over the top of one wall.

Preferably the conveyor has an open mouth through which the particulate material is discharged which is located at said one of the four walls. Thus the conveyor does not include any part which extends into the hopper and merely acts to force the material through the wall into the hopper. However it may include a duct portion carrying the material into a specific location in the hopper.

Preferably the conveyor extends through one of the side walls rather than an end wall to discharge the particulate material into the hopper.

Preferably the conveyor extends through the wall at a height thereon below the drive member so as to enter the hopper below the location in the hopper where the bale is located and is yet to be processed. Thus the conveyor does not interfere with the bale.

More preferably the conveyor extends through the wall at a height thereon adjacent or below the flail roller so as to enter the hopper generally in the disintegration area.

Preferably the conveyor extends through one of the side walls at a position thereon spaced from the end walls and preferably approximately mid way between the end walls. In this way the material is best mixed with the processed material while it is being processed to ensure that the particulate material is intimately mixed rather than as a general layer at the top or bottom of the row of hay.

Preferably the container is mounted on the vehicle along one of the side walls and preferably the one which is opposite the discharge opening.

Preferably the container is mounted on one of the side walls of the hopper so as to be carried thereby. However the container can also be mounted on other components of the vehicle including particularly a frame of the vehicle on which the hopper sits.

Preferably the conveyor comprises a tube extending from the container to the hopper with an auger flight within the tube. However other types of conveyor can be used including belts. The tube is used preferably to contain the material as it is transferred and when located at the side wall the tube can be of minimum length.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
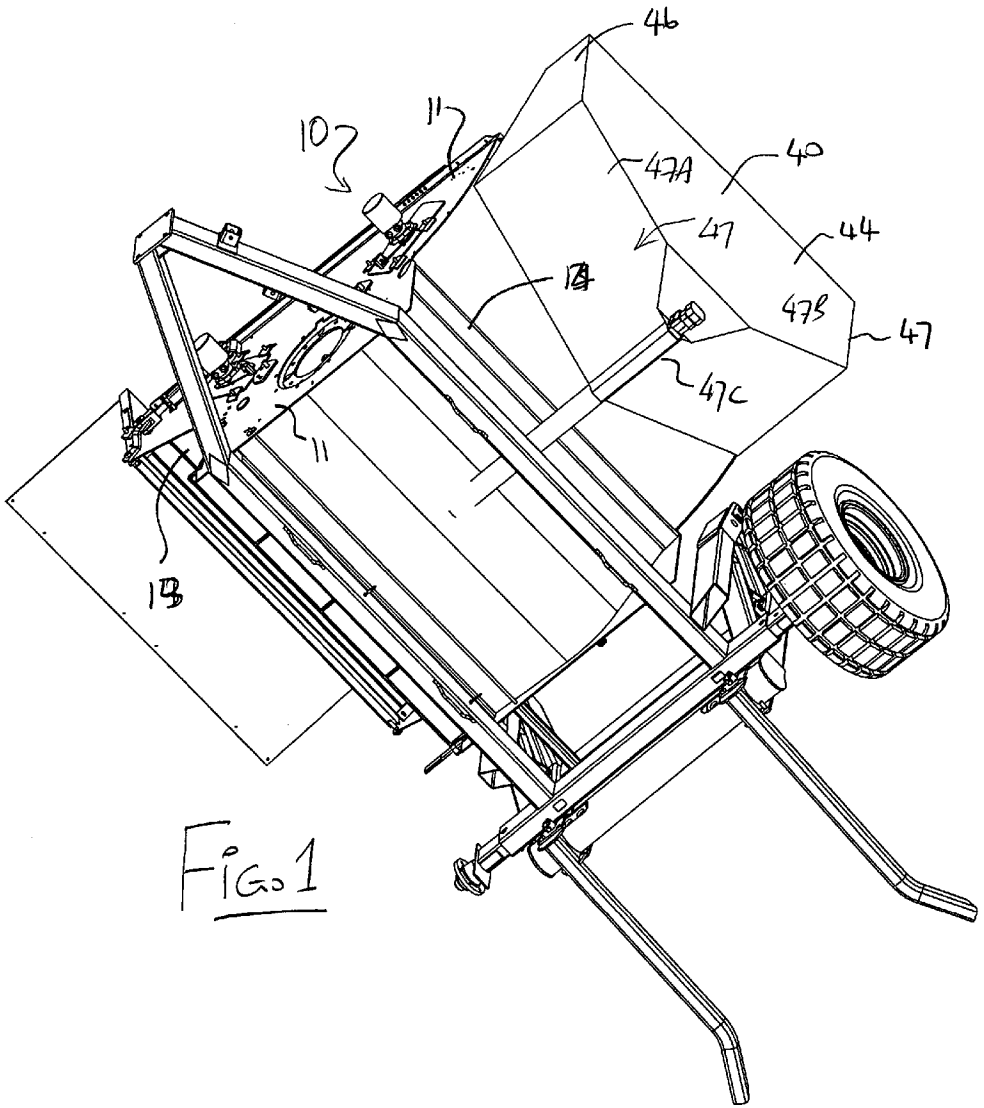
FIG. 1 is an isometric view from the bottom and one side of a bale processor according to present invention.
Figure 2:
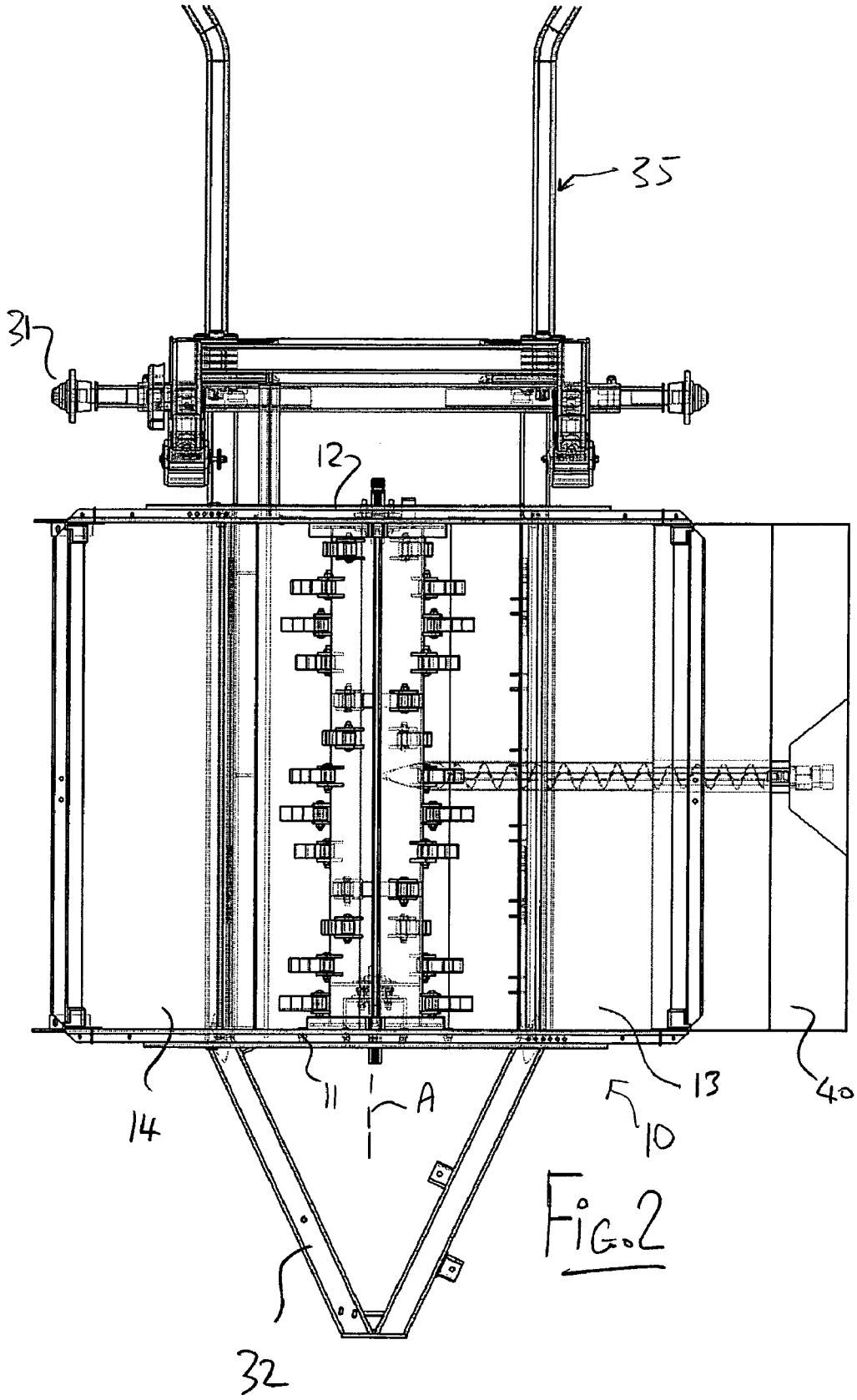
FIG. 2 is a top plan view of the bale processor of FIG. 1.
Figure 3:
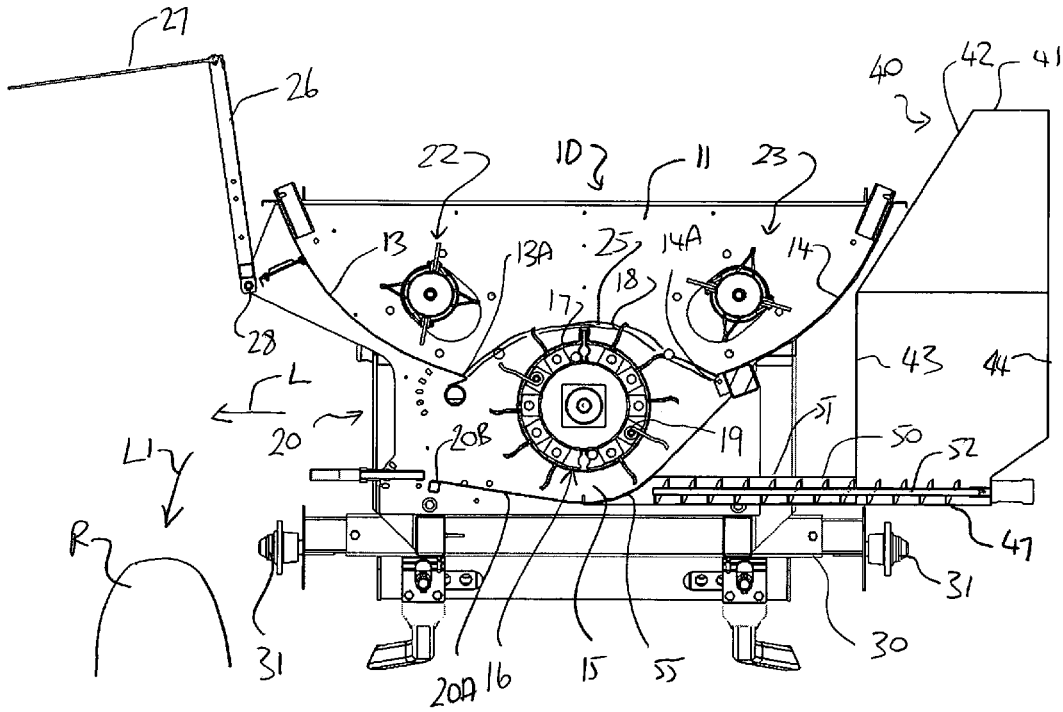
FIG. 3 is a transverse cross sectional view of the bale processor of FIG. 1.
Figure 4:
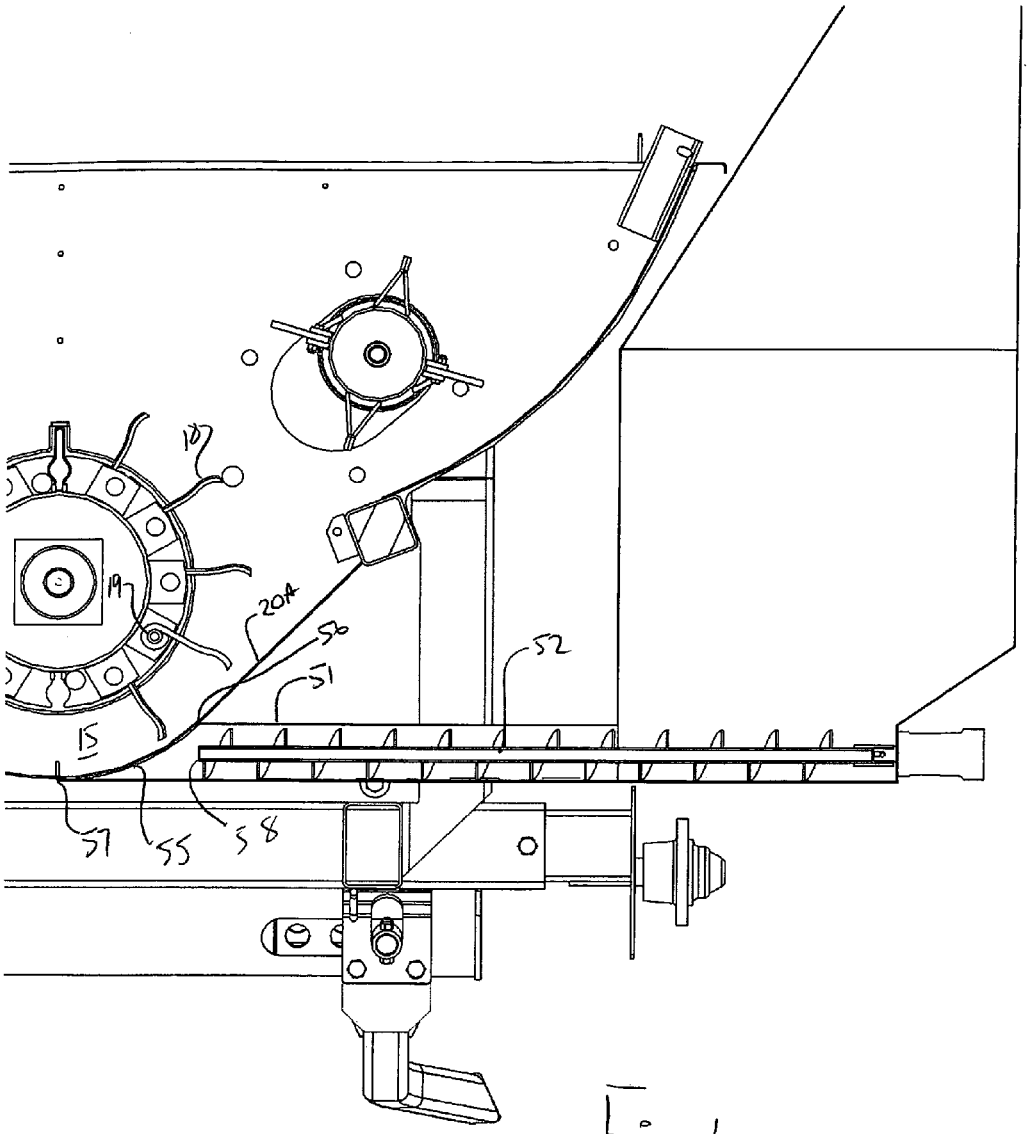
FIG. 4 is a transverse cross sectional view similar to that of FIG. 3 on an enlarged scale.

A conventional bale processor as shown in FIG. 1 of the type shown in the above patents of the present Assignee which are incorporated herein by reference, includes a hopper 10 designed by end walls 11 and 12 together with side walls 13 and 14. The side walls converge inwardly and downwardly to a disintegration area 15 at the bottom of the hopper within which is located a flail roller or rotor 16. The rotor forms a cylindrical wall having a smooth cylindrical outer surface as indicated at 17 and carries a plurality of flails 18 which are mounted on pivotal supports 19 attached adjacent to the outer surface of the cylindrical wall 17. The rotor is mounted on suitable bearings so as to be carried within the hopper extending longitudinally of the hopper with an axis A of the rotor extending along the length of the hopper from one end wall to the other end wall.

The side wall 13 includes a discharge opening 20 in the area of the flail roller so that material grasped by the flails of the flail roller is rotated around underneath the flail roller over a wall 20A which generally follows the exterior edge of the path of the flails and discharged through the discharge opening. The discharge opening thus forms a slot across the width of the wall 13 in the disintegration area. A drive assembly is mounted within the hopper and is formed by one or more drive rollers 22 and 23 which are arranged in the hopper parallel to the axis of the rotor so the bale sits on the drive roller or drive rollers and upon a grate (not shown) over the flail roller so that the bale is rotated within the hopper while the flail acts to remove the material form the bottom of the bale.

The walls 13 and 14 converge inwardly and downwardly to respective steps 13A and 14A at which the discharge area 15 is located. The discharge area defines a wall 20A which extends from the edge 14A downwardly and smoothly curved around underneath the cylinder defined by the outside edges of the flails and then extends outwardly to one side to an edge 20B located underneath the edge 13A which defines the outlet 20. Thus rotation of the flail roller acts to expel processed bale material by rotation of the flail roller in the clockwise direction so that the bale sitting on top of the drive member 22 and 23 and on top of grate bars 25 has the lowermost part thereof grasped by the flails, carried around through the disintegration area and expelled through the opening 20. The material discharged from the opening 20 is controlled by a control panel 26 with a depending wall 27 which is pivotal around a pivot mounting 28. Thus the guide 26 can be raised and lowered to impact upon the discharge material or to release the material depending upon requirements. In many cases the guide panel 26 is moved to the lowered position so that impacts on the material exiting along the line L so that the material is discharged downwardly as indicated along the line L1 to form a row R on the ground.

The hopper 10 and the component associated therewith is mounted on a chassis 30 carried on ground wheels mounted on hubs 31 so as to transport the hopper on a wheeled vehicle towed by a front hitch 32.

A loading fork assembly generally indicated at 35 is arranged at the rear behind the wall 12 to load bales into the hopper.

In order to provide mixing of the processed bale material with a particulate material such as grain, there is provided a container or hopper 40 which is arranged along the side wall 14. The hopper 40 can be mounted on the frame or more preferably may be mounted directly on the side wall of the hopper 10. The hopper 40 has a top wall 41 with a suitable opening through which the hopper can be filled. An inclined side wall 42 generally follows the path of the side wall 14 so that a part of the hopper is located underneath the sidewall 14 as close as possible to the side wall 14 so as to minimize the width of the structure. Vertical side walls 43 and 44 are provided which define inside and outside surfaces of the hopper. The hopper includes end walls 46 and 47 which are located approximately in the common plane with the end walls 11 and 12. Thus the hopper or container 40 provides relatively large storage area for particulate material to be supplemented into the processed bale.

The hopper further includes a bottom wall 47 which is defined by two downwardly and inwardly inclined sections 47A and 47B which converge to a bottom apex 47C. Thus material within the hopper 40 tends to slide and converge at the apex 47C for discharge from the base of the hopper. The apex 47C is arranged on a centre line of the hopper 40 which is common with a center line of the hopper 11 midway between the end walls 11 and 12. Thus the apex 47C is spaced from both of the end walls 11 and 12. At the apex 47C is mounted an auger 50 having an auger tube 51 and an internal flight 52. The tube 50 extends from the base wall 47 at the apex 47C generally horizontally across the space between the hopper 40 and the hopper 11 so that a discharge end of the tube 51 meets the wall 20A at the disintegration area 15 at the lowermost apex of the wall 20A underneath the flail roller. Thus the end of the tube 50 breaks out onto an opening 55 in the bottom wall 20A. The opening 55 commences at an upper edge 56 and extends downwardly and inwardly to a bottom edge 57. Thus the opening 55 is generally oval in shape breaking out through the wall 20A. None of the tube 51 nor the auger flight 52 projects into the interior of the hopper 10 but instead the auger flight 52 has an end 58 terminating within the tube 51 so that material covered by the auger flight is simply forced through the opening 55 into the disintegration area 15. In this way the flails 18 can be arranged to follow their conventional path without any interference from the auger, either the tube nor the flight but can receive the particulate material as it is forced from the tube 51 into the disintegration area 51.

The outside edges of the flails 18 sweep over the wall 20A with a shallow clearance so that the particulate material picked up by the flail roller is carried over the wall 20A and is discharged with the processed material through the opening 20.

While the opening 55 and the tube 51 are preferably located right at the base of the wall 20A at a height underneath the flail roller, the tube 51 may be located at a raised position either aligned with the flail roller or even above the flail roller provided that the material is fed into the system at a position where it does not interfere with or contact the bale and so that the material is mixed with the processed bale material or hay within the disintegration area.

In the arrangement as shown with the tube 51 at the bottom of the hopper 10, this basically maximizes the depth of the hopper 40 so as to provide the maximum amount of material. Preferably the location of the tube 51 in the front to rear direction places the particulate material or grain generally at the centre of the hopper 10. It will understood that introducing the grain into the center section of the processor defined by the hopper 10 will result in the grain having a higher concentration in the center section of the processed bale material in the windrow or row R. Introducing the grain at the front of the bale processor would result in the grain being concentrated in the bottom of the windrow. Introducing grain at the rear of the processor would result in the grain being concentrated at the top of the windrow. However it is beneficial if the grain material is concentrated at the center of the windrow to achieve the best mix of grain and processed bale material. When the grain is so mixed, the livestock fed by the materials will tend to eat more of the mixed ration as opposed to being able to pick out the more attractive grain which would be possible if the grain were concentrated on top of the processed bale material. Thus the positioning of the tube 50 is preferably at the centre but could be moved forwardly or rearwardly if required to provide a location of the grain material at a different position within the processed bale material. With the grain being introduced into the center of the processing chamber, the grain tank is symmetrical front to rear and there will be no changes to the grain tank system when it is mounted to a right hand or left hand discharge bale processor.

In addition the arrangement can be used with the arrangement shown in the above patent of the present assignee which is directed to the construction where the hopper can be rotated on the wheeled vehicle through 180 degrees to provide a left or right discharge as required by the operator. When such rotation occurs the hopper 40 which is attached to the frame section carrying the hopper 10 also is rotated with the hopper 10 so that it remains on the side wall opposite to the discharge. In this way the tube 51 is spaced from the discharge and does not interfere any way with the discharge since it feeds the material to the opposite side from the discharge through the side wall 14.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A bale processor comprising:

a hopper for receiving a material in a bale to be processed having four walls including two side walls and two end walls arranged to define an open top through which the bale is loaded;

the two side walls converging inwardly and downwardly to a lower disintegration area;

a flail roller mounted in the disintegration area and rotatable about an axis extending generally along the side walls and transverse to the end walls to generate processed material removed from the bale;

at least one drive member in the hopper for applying a rotation force to the bale tending to rotate the bale around an axis generally parallel to the flail roller axis;

one of the side walls having a discharge opening at the disintegration area for discharge of the processed material removed from the bale by the flail roller;

the hopper being arranged to be mounted on a wheeled vehicle for movement forwardly in a direction of operation;

the discharge opening being arranged to form the processed material into a row along the side of the wheeled vehicle as the vehicle moves forwardly;

a container arranged to be carried on the vehicle for receiving a particulate material;

a conveyor for transporting the particulate material from the container;

the conveyor being arranged to transport the particulate material into the hopper so as to be discharged from the conveyor into the hopper to mix with the material prior to discharge through the discharge opening.

2. The bale processor according to claim 1 wherein the conveyor extends through one of the four walls to discharge the particulate material into the hopper.

3. The bale processor according to claim 1 wherein the conveyor has an open mouth through which the particulate material is discharged which is located at said one of the four walls.

4. The bale processor according to claim 1 wherein the conveyor extends through one of the side walls to discharge the particulate material into the hopper.

5. The bale processor according to claim 1 wherein the conveyor has an open mouth through which the particulate material is discharged which is located at said one of the side walls.

6. The bale processor according to claim 1 wherein the conveyor extends through said one of the four walls at a height thereon below the drive member so as to enter the hopper below the bale.

7. The bale processor according to claim 1 wherein the conveyor extends through said one of the four walls at a height thereon adjacent the flail roller so as to enter the hopper generally in the disintegration area.

8. The bale processor according to claim 1 wherein the conveyor extends through said one of the four walls at a height thereon below the flail roller so as to enter the hopper in the disintegration area.

9. The bale processor according to claim 1 wherein the conveyor extends through one of the side walls at a height thereon below the flail roller so as to enter the hopper in the disintegration area.

10. The bale processor according to claim 1 wherein the conveyor extends through one of the side walls at a position thereon spaced from the end walls.

11. The bale processor according to claim 1 wherein the conveyor extends through one of the side walls at a position thereon approximately mid way between the end walls.

12. The bale processor according to claim 1 wherein the container is mounted on the vehicle along one of the side walls.

13. The bale processor according to claim 1 wherein the container is mounted on the vehicle along that one of the side walls which is opposite the discharge opening.

14. The bale processor according to claim 1 wherein the container is mounted on one of the side walls of the hopper so as to be carried thereby.

15. The bale processor according to claim 1 wherein the conveyor comprises a tube extending from the container to the hopper with an auger flight within the tube.

* * * * *